United States Patent [19]

Balmer et al.

[11] Patent Number: 4,612,846

[45] Date of Patent: Sep. 23, 1986

[54] HIGH PRESSURE HYDRAULIC DISTRIBUTOR HAVING A MECHANICALLY CONTROLLED DISCHARGE VALVE

[75] Inventors: Clifford J. Balmer, St. Germain-en-Laye; Richard Goddard, Senlis, both of France

[73] Assignee: Vickers Systems S.A., Saint-Quen l'Aumone, France

[21] Appl. No.: 700,624

[22] Filed: Feb. 12, 1985

[30] Foreign Application Priority Data

Feb. 22, 1984 [FR] France ..... 84 02669

[51] Int. Cl.[4] ..... F15B 11/08

[52] U.S. Cl. ..... 91/457; 137/596.2

[58] Field of Search ..... 91/454, 457, 459, 461; 60/484; 137/596.2; 251/38, 44

[56] References Cited

U.S. PATENT DOCUMENTS

| | | | |
|---|---|---|---|
| 3,376,792 | 4/1968 | Clarke et al. | 91/454 X |
| 3,437,012 | 4/1969 | Bjorklund | 137/596.2 X |
| 3,473,566 | 10/1969 | Peppel | 137/596.2 |
| 3,599,675 | 8/1971 | Sierenpiper | 137/596.2 |
| 3,792,715 | 2/1974 | Parrett et al. | 137/493 |
| 3,996,840 | 12/1976 | Futamata et al. | 91/457 |

FOREIGN PATENT DOCUMENTS

| | | |
|---|---|---|
| 995278 | 11/1951 | France . |
| WO80/606 | 4/1980 | PCT Int'l Appl. . |
| 978113 | 12/1964 | United Kingdom . |

*Primary Examiner*—Edward K. Look

*Attorney, Agent, or Firm*—Fiddler & Levine

[57] ABSTRACT

The invention involves a new structure for a distributor for a hydraulic fluid utilization means, such as a single-acting jack, controlled by the distributor in any position. The distributor includes a spool-type valve and a hollow piston valve which is piloted by a needle valve. The needle valve and spool-type valve are both mechanically connected to a single mechanical lever.

18 Claims, 11 Drawing Figures

HIGH PRESSURE HYDRAULIC DISTRIBUTOR HAVING A MECHANICALLY CONTROLLED DISCHARGE VALVE

BACKGROUND OF THE INVENTION

The present invention relates to a high pressure hydraulic distributor.

More precisely, it relates to a hydraulic distributor of the type comprising:

a body itself having an inlet duct having connection means to a first source of hydraulic fluid under pressure, a first outlet duct having connection means to utilisation means of such a fluid, a second outlet duct having connection means to a fluid reservoir, first distributor means interposed between the inlet duct and the first outlet duct inside the body for, at will, establishing a fluid feed circuit from the inlet duct towards the first outlet duct or closing this circuit, second distributor means, interposed between the first inlet duct and the second outlet duct inside the body for, at will, establishing a fluid return circuit from the first outlet duct to the second outlet duct or closing this circuit, control means for the first and second distributor means for, at will, establishing one of the said circuits and closing the other or closing these two circuits simultaneously, and it particularly concerns such distributors intended for high pressure applications, that is to say for example when the utilisation means are constituted by hydraulic jacks carrying out the functions of handling loads or displacing members, on mobile mechanical handling machines or on agricultural machines.

The distributors of this type, having single-acting jacks, are particularly appreciated insofar that they permit limiting the powering of the source of hydraulic fluid under pressure to operations for which the jacks are active, which correspond to the establishment of the feed circuit; for operations for which the jack is passive, which correspond to the establishment of the return circuit, on the contrary, the source of hydraulic fluid is not powered, this takes on a particular importance in the case of mobile electric machines powered from a bank of accumulators powering in particular an electric drive motor of a pump constituting the source of hydraulic fluid, insofar as this battery is economised.

Nevertheless, the practical embodiment of distributors of this type is difficult since particularly in the interests of safety, it is desirable that single-acting jacks controlled by such distributors have stable positions other than their passive end of stroke position; in fact, since the jacks are used in such other positions, any leakage particularly inside the distributor consititutes an obstacle to such stability.

THE INVENTION

An object of the present invention is precisely to propose a new structure of a distributor of the type mentioned permitting the stabilising of hydraulic fluid utilisation means, such as a single-acting jack, controlled by the distributor in any position, whilst preserving particularly the important advantage of the absence of powering from the source of hydraulic fluid whilst the utilisation means are passive.

The present invention also has for an object control of the progressiveness of functioning of the hydraulic fluid utilisation means whilst they are passive.

For this, the hydraulic distributor according to the invention, of the type mentioned, is characterised in that the second distributor means comprise:

a return duct arranged in the body in a predetermined direction, which return duct, on the one hand, opens into the second outlet duct and on the other hand, meets the first outlet duct in an intersection zone positioned between the connection means to the utilisation means and the first distributor means and has a closed end opposite from the second outlet duct with respect to this intersection zone, a non-return valve positioned in the first outlet duct between this intersection zone and the first distributor means, this valve being resiliently urged closed in a direction going from said intersection zone towards the first distributor means, a piston slidingly mounted in the said direction, in the return duct, in which intersection zone and on both sides of it, this piston having end zones respectively between this zone and the second outlet duct and between this zone and the said end of the return duct, the end zone situated between the intersection zone and the second outlet duct having, transversely of the said direction, a cross-section less than that of the end zone positioned between the intersection zone and the said end of the return duct, abutment means arranged complementarily on the piston and in the return duct, between the said intersection zone and the second outlet duct, the piston having between the corresponding abutment means and its end situated between the intersection zone and the said end of the return duct a length less than that which the return duct has between its end and the corresponding abutment means, these abutment means jointly defining the fluid-tight abutment of the piston with respect to the return duct in a direction going from the said end of the latter towards the second outlet duct, sliding contact means fluid-tight between the piston and the return duct between said intersection zone and said end of said return duct, a passage forming an integral part of the second outlet duct, jointly limited by the piston and the return duct in the said intersection zone, between the said abutment means and the said sliding fluid-tight contact means, a chamber limited jointly by the piston and the return duct, between the said end of it and the said fluid-tight sliding contact means, a first calibrated passage opening on the one hand into the first outlet duct, between the said intersection zone and the said connection means to the said utilisation means, and on the other hand into the said chamber, a second calibrated passage, arranged in the piston, in the said direction and opening on the one hand into the said chamber and on the other hand into the end zone of the piston positioned between the said intersection zone and the second outlet duct, the second calibrated passage having a cross-section greater than that of the first calibrated passage, a needle arranged in the said chamber opposite the second calibrated passage in the said direction, a fluid-tight seat for the needle, arranged in the piston about the second calibrated passage and constituting an abutment for the needle, with respect to the piston, in a direction going from the said chamber towards the second outlet duct in the said direction, resilient means urging the needle towards the said fluid-tight seat, a shaft of the needle fixed to the latter, control means transferring a control in the direction of establishing the return circuit by a movement of the needle in the direction of a separation with respect to the fluid-tight seat, and a control in the direction of closing these two circuits or in the direction of establishing the feed circuit by a free application of the needle onto the fluid-tight seat under the action of the resilient urging means.

The assembly formed, inside the return duct, by the piston and the associated needle constitute a mechanically controlled valve, permitting on the one hand, in cooperation with the non-return valve interposed in the first outlet duct, establishing a positive fluid-tightness since the common control means of the first and second distributor means occupy their closed position simultaneously of the feed circuit and the return circuit, which permits in practice, achieving in any position of the hydraulic fluid under pressure utilisation means a stable position opposing any leak towards the second outlet duct and towards the reservoir of hydraulic fluid, and on the other hand, since the control means occupy a closed position of the feed circuit and opening of the return circuit, establishing a controlled flow of fluid in this return circuit and in consequence giving the operation of the utilisation means in the passive state any progressivity required, as will appear below.

Advantageously, according to another characteristic of the distributor according to the invention, the body has in the said direction a passage orifice for the shaft of the needle, opening on one side towards the outside of the body and on the other side into the said chamber, and the shaft has, across this orifice, a section having transversely to the said direction a greater cross-section than the cross-section of the second calibrated passage.

Thus, as will appear later, any inadmissable increase in the pressure of fluid in the utilisation means whilst the return circuit is closed can cause opening of this circuit, which creates safety against such over-pressure.

The second distributor means being thus constituted, the first distributor means can be in themselves arranged, in a traditional manner, in the form of a slide valve distributor arranged slidingly in the body and cooperating with the appropriate chambers and passages, arranged in it in a manner easily achieved by the man in the art.

Other characteristics and advantages of the invention will appear from the following description of a non-limitative embodiment and the accompanying drawings which form an integral part of the description.

THE DRAWINGS

Figure 2:
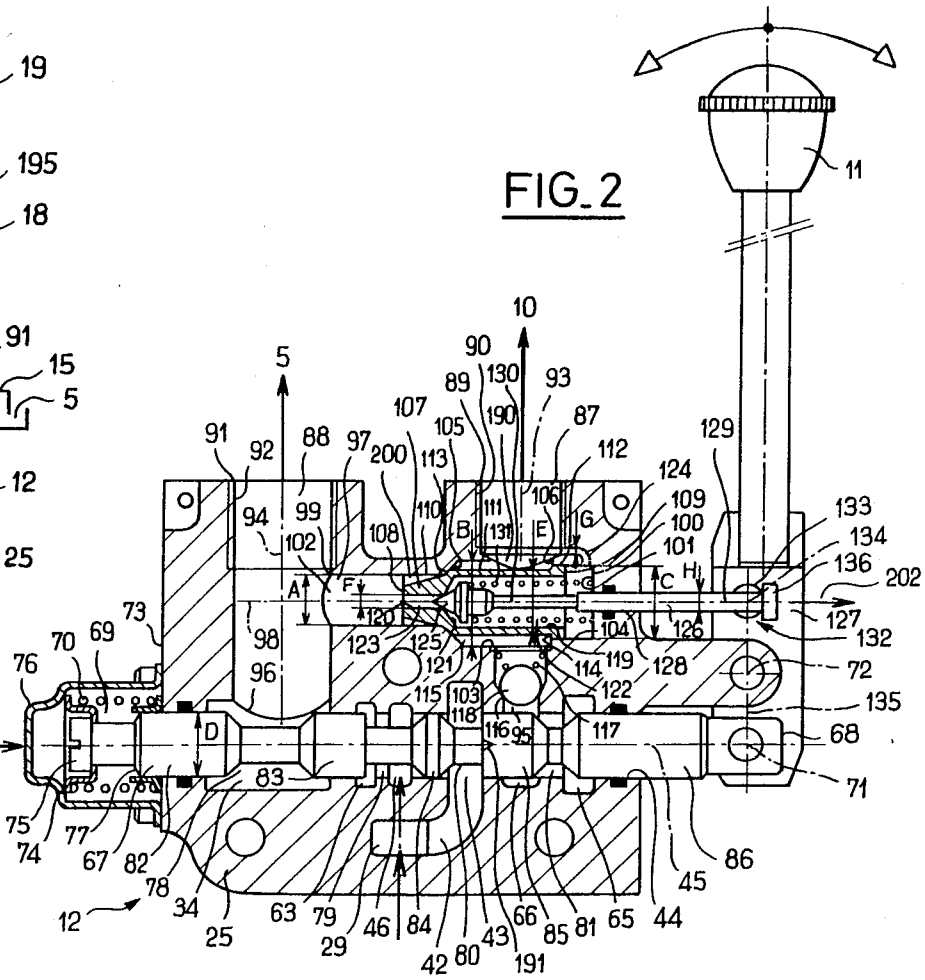
FIGS. 2 and 3 show respectively a cross-section of a distributor according to the invention and a diagram showing the incorporation of this distributor into the hydraulic circuit of the truck shown in FIG. 1, the distributor being in a position closing both the feed and return circuits.
Figure 3:
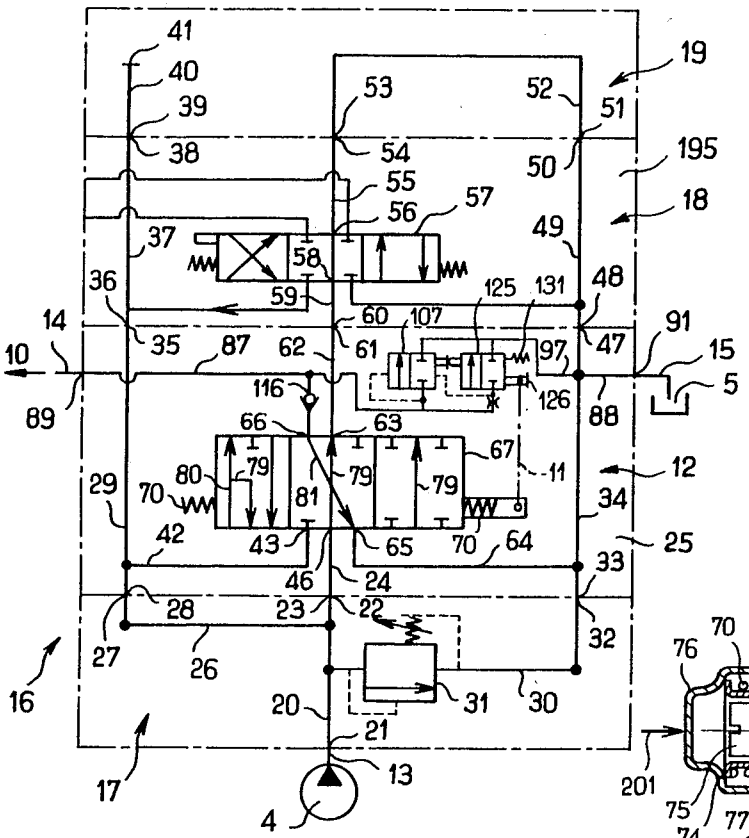
Figure 4:
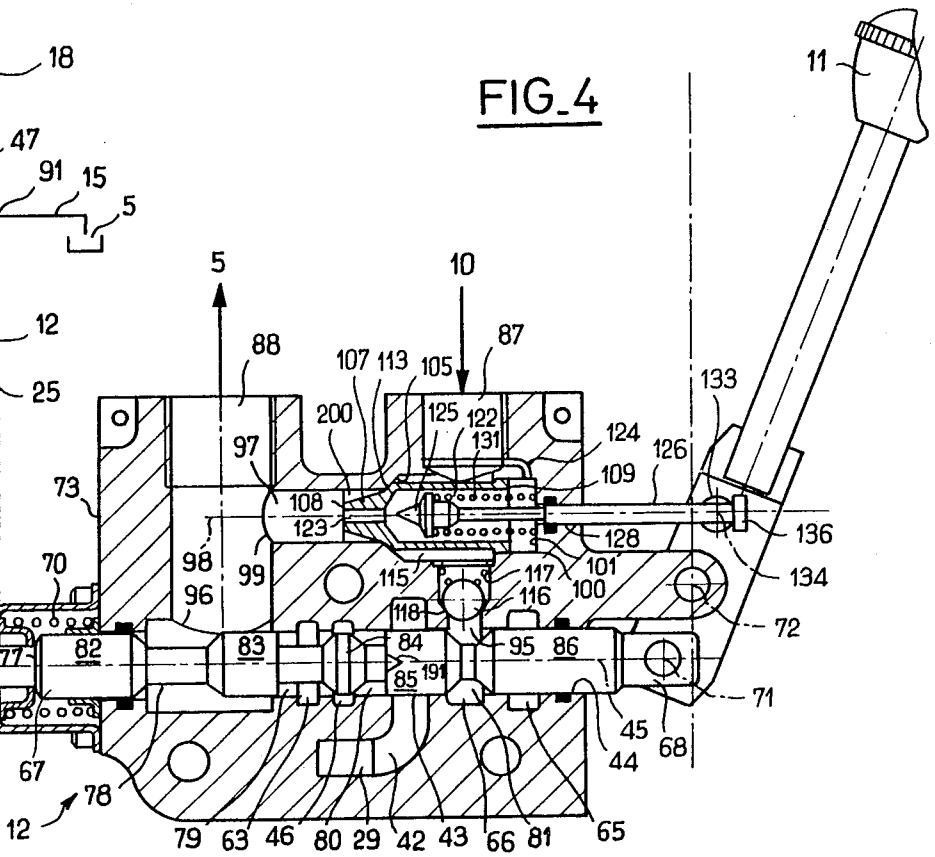
Figure 5:
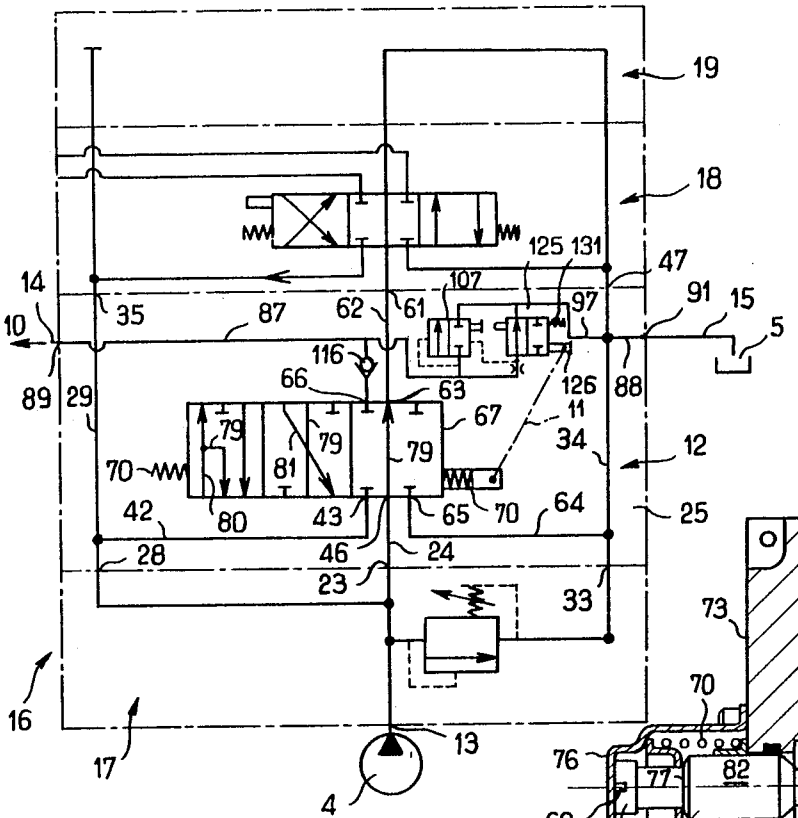

FIGS. 4 AND 5 correspond respectively to FIGS. 2 and 3 and show the distributor in an intermediate stage of opening of the return circuit.

Figure 6:
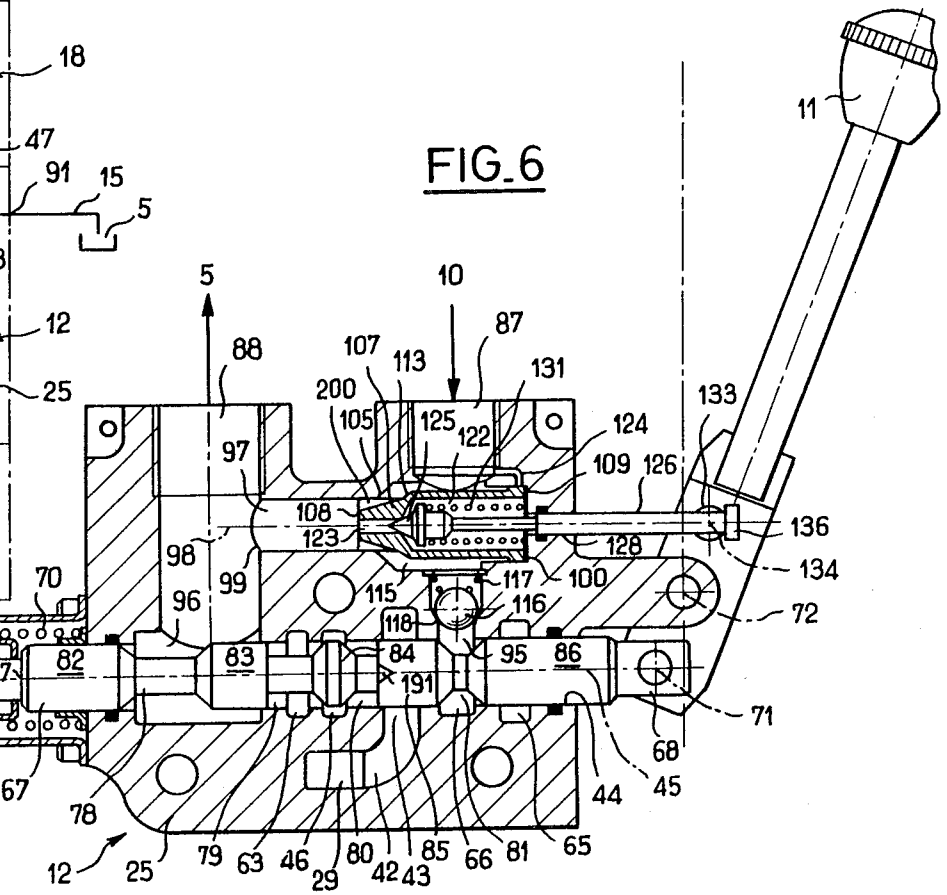
Figure 7:
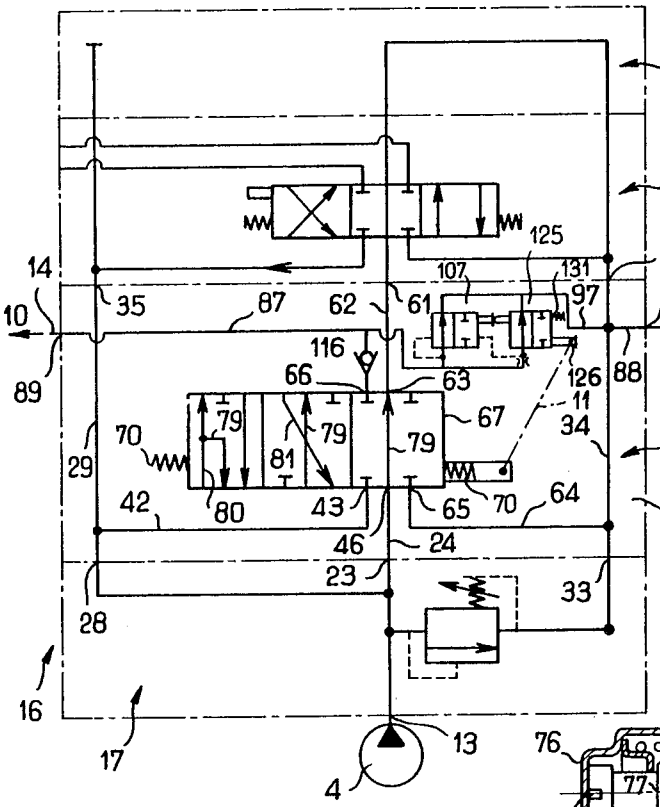

FIGS. 6 and 7 correspond respectively to FIGS. 2 and 3 and show the distributor in the final stage of opening of the return circuit.

Figure 8:
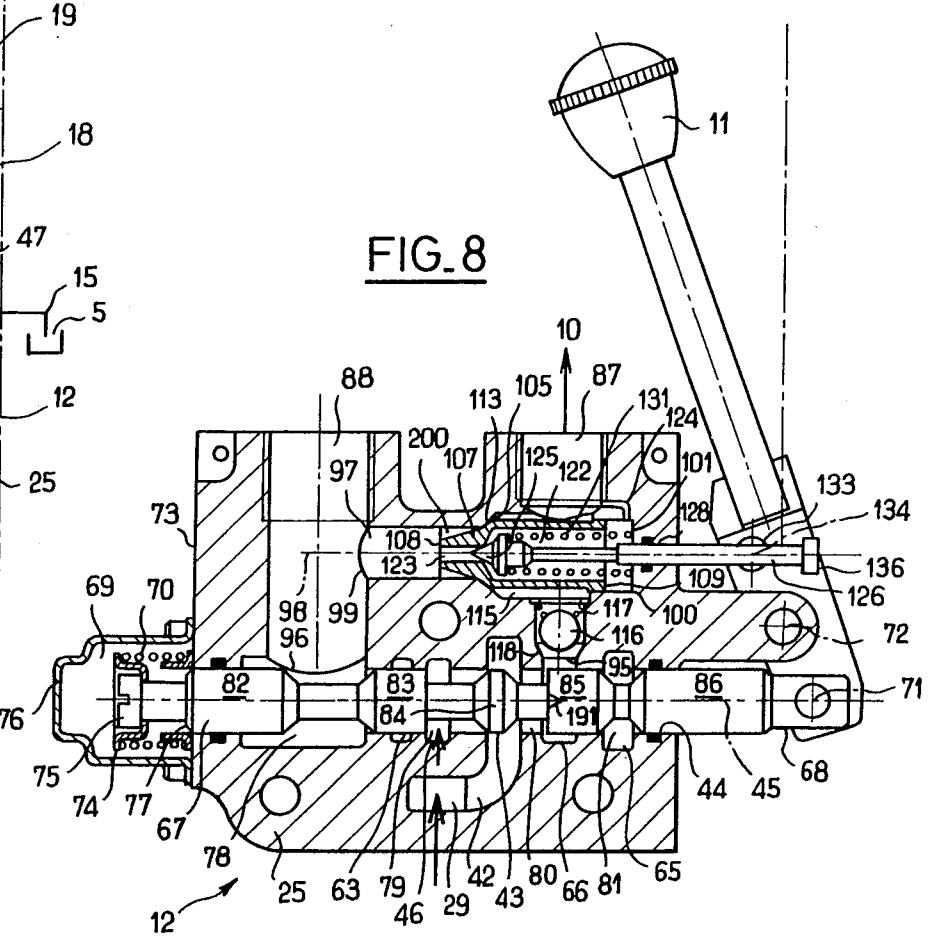
Figure 9:
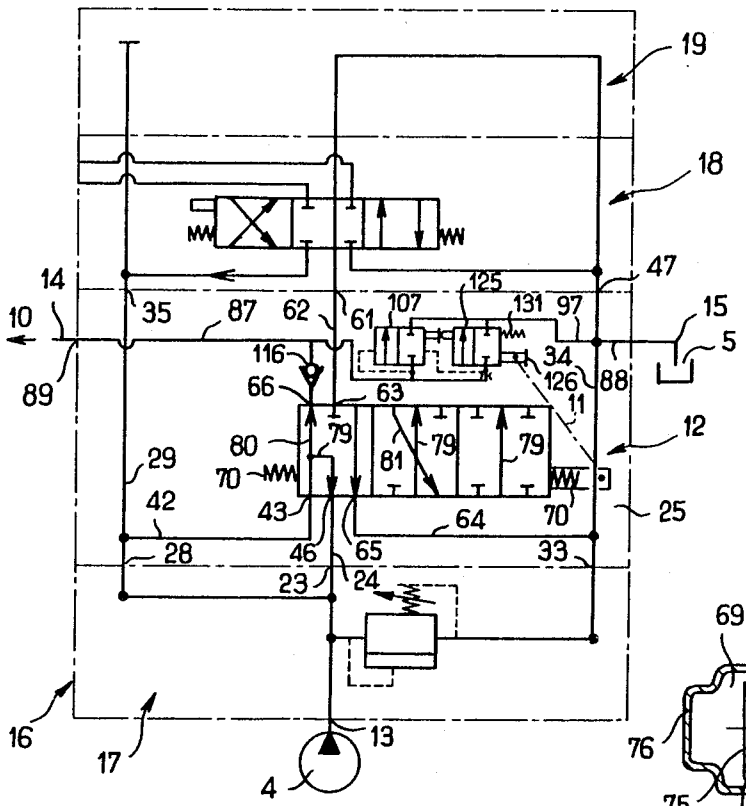

FIGS. 8 AND 9 correspond respectively to FIGS. 2 and 3 and show the distributor opening the feed circuit.

Figure 10:
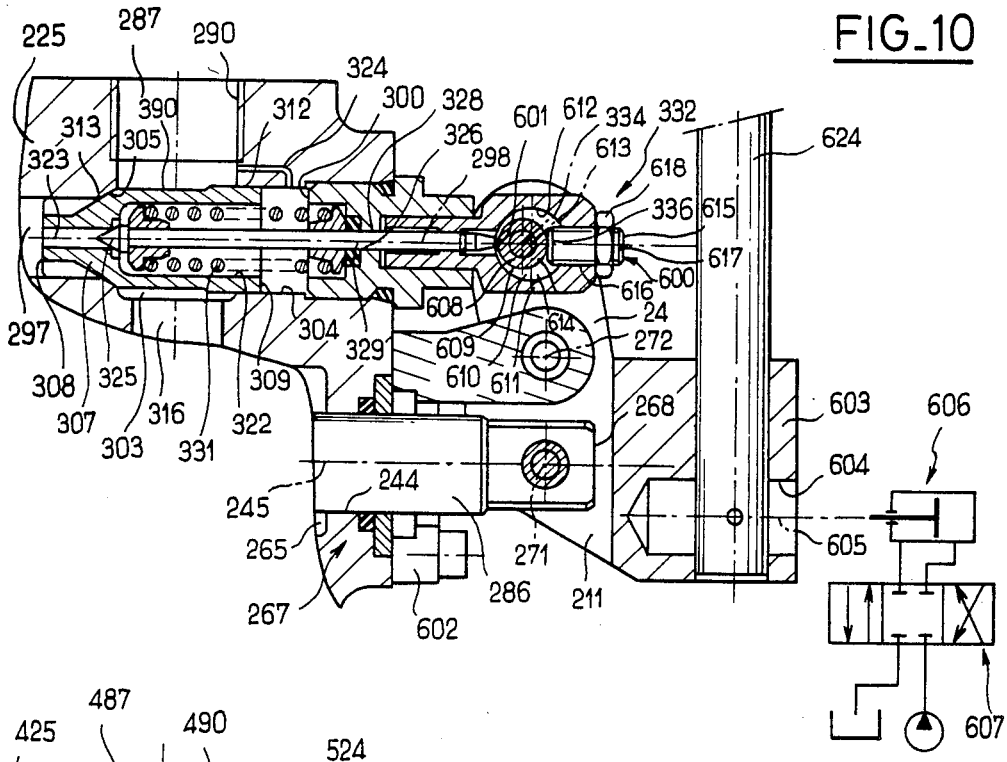

FIG. 10 is a scrap view similar to FIG. 2 and shows a variant of the arrangement of the control means of the first and second distributor means.

Figure 11:
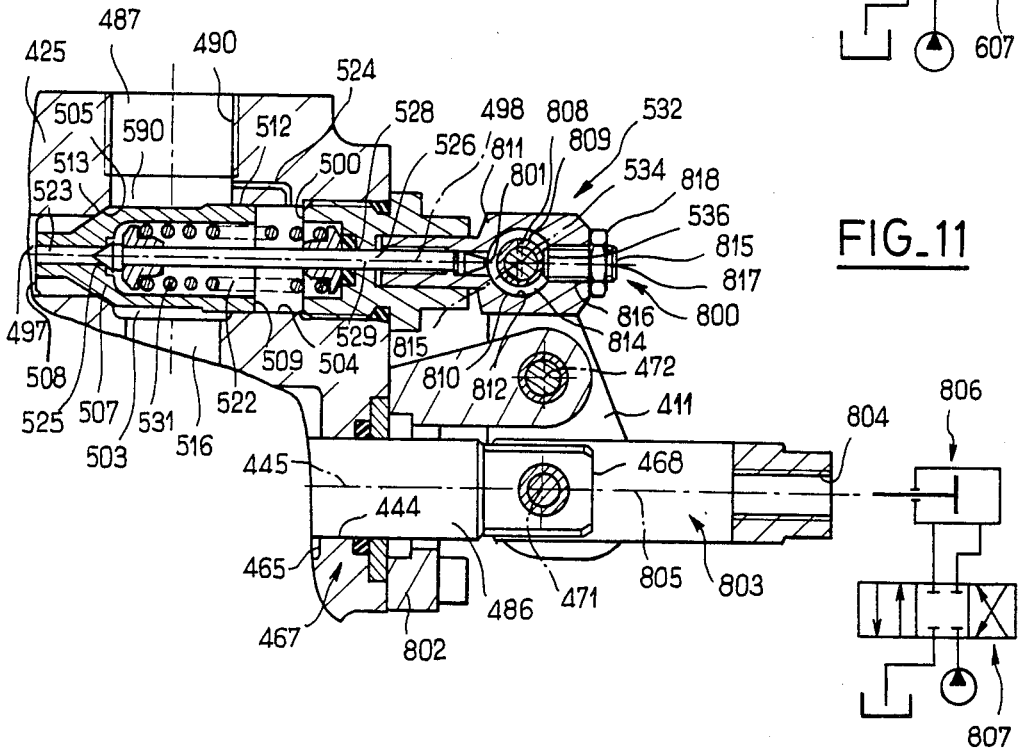

FIG. 11 shows, in a view similar to FIG. 10, another variant of the arrangement of the control piece.

THE EMBODIMENT

Figure 1:
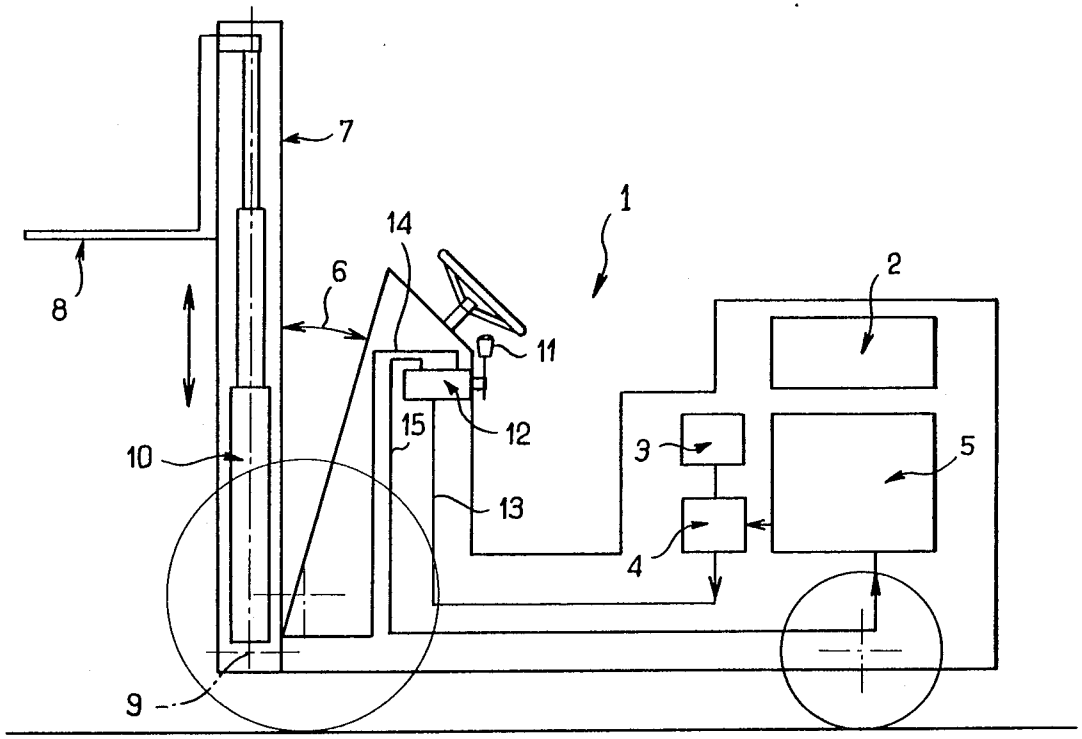
FIG. 1 shows, by way of example of a machine putting the present invention into operation in a particularly advantageous manner, a forklift truck, with electric propulsion, of which are shown only the parts necessary for comprehending the description which follows.

In FIG. 1 is shown an electrically propelled forklift truck 1, electrically powered by a set of accumulators 2; this set of accumulators powering also an electric drive motor 3 for a pump 4 whose function is to pump hydraulic fluid in a reservoir 5 for powering with the fluid a certain number of jacks, for instance a non-illustrated double acting jack for tilting 6 a mast 7 carrying the fork 8, about a horizontal axis 9 connected to the truck 1, and a single acting jack 10 intended to positively displace the fork 8 in an upwards direction along the mast 7, and to allow the fork 8 to passively descend along the length of the mast 7, at the will of the operator expressed by action on a control lever 11 of a distributor 12 according to the invention, which will be described with reference to FIGS. 2 to 9 and has for this purpose connection means with a duct 13 connected to the pump 4, for receiving from the latter hydraulic fluid under pressure when it is in use, with a first outlet duct 14, ensuring connection of this distributor with the chamber (not shown) of the jack for introducing hydraulic fluid into it and activating the jack, and with a second outlet duct 15, connecting the distributor 12 to the reservoir 5 for ensuring, in conjunction with the duct 14, return of the fluid to the reservoir 5 when the jack 10 functions in its passive manner.

In FIGS. 3, 5, 7 and 9 is shown diagrammatically the integrated distributor 12 into the first distribution section in a bank of distributors fed in parallel.

In these Figures will be found the ducts 13,14,15 as well as the pump 4, the reservoir 5 and the single acting jack 10.

The bank of distributors, designated by the general reference 16, have an inlet block 17, to which is directly connected the first distribution section defined by the distributor 12, to which is connected in its turn a second distribution section constituted by a distributor of known type 18 intended for example to feed the double acting jack (not shown) for tilting 6 the mast 7, the section 18 being connected to a terminal block 19; naturally the distributor consituting the second section 18 can be different from the one illustrated, and a number of distribution sections can be interposed in place of the second section 18 between the first section 12 and the end block 19; the latter also possibly being directly connected to the first section 12.

The inlet block 17 defines a first hydraulic feed duct 20, which has a first end 21 having connection means to the duct 13 and a second end 22 having connection means with the first end 23 of a duct 24 of the body 25 of the distributor 12; between the ends 21 and 22 of the fluid duct 20 leads from the latter, to the interior of the inlet block 17, both a second fluid feed duct 26, having in addition an end 27 provided with connection means to an end 28 of a duct 29 arranged in the body 25 of the distributor 12, and a return duct 30 to the reservoir 5, which duct 30 has inside the inlet block 17 a pressure regulator 31 and has an end 32 provided with connection means at an end 33 of the duct 34 of the body 25 of the distributor 12; in a manner known in itself, the ducts 24,29,34 are connected, by their respective ends 23,28,33, to the ends 22,27,32 of the ducts 20,26,30 of inlet block 17 by the simple juxtaposition of the body 25 of the distributor 12 to the block 17 during assembly, the connection means being constituted by the assembly means and of the body 25 and of the block 17 and by fluid-tight joints about the different ducts before being connected.

The duct 29 traverses the body 25 of the distributor 12 from one side to the other, having a second end 35 provided with connection means to an end 36 of a similar duct 37 of a body 195 of the distributor constituting the section 18, this duct 37 is continued across this distributor body as far as the end 38 provided with connection means to an end 39 of a duct 40 arranged in the end block 19, and in which this duct 40 has a closed end 41.

Between the ends 28 and 35 of the duct 29 leading from this, at the interior of the body 25 of the distributor 12, a duct 42 opening, by an end 43, into a bore 44 traversing the body 25 from one side to the other, and following a rectilinear axis 45 perpendicular to the direction following which the duct 29 traverses the latter.

The duct 24 has itself a second end 46 by which it also opens into the bore 44, in the manner of an annular groove.

The duct 34 itself traverses the body 25 from one side to the other, like the duct 29, having a second end 47 provided with connection means to a first end 48 of a duct 49 of the distributor body 195 constituting the second section 18, this duct 49 extending across this body 195 as far as a second end 50 at which it has connection means with a first end 51 of a duct 52 arranged in the end block 19, this duct 52 opening in addition out of the block 19 by a second end 53 provided with connection means to a first end 54 of a duct 55 having a second end 56 which a slide valve 57 of the distributor constituting the second section 18 permits connection to an end 58 of the other duct 59 of the body of this distributor 18, which duct 59 has an other end 60 provided with connection means to a first end 61 of a duct 62 of the body 25 of the distributor 12; this duct 62 has in addition a second end 63 by which it opens into the bore 44, in the form of an annular groove.

Finally, from the duct 34 leads, at the interior of the body 25, a duct 64 opening by an end 65, in the form of an annular groove, into the bore 44.

If one refers to the axis 45 of the latter, the duct 34, the groove 63, concentric with this axis 45, the groove 46, concentric with the same axis, the end 43 of the duct 42, an annular groove 66 concentric with the axis 45 and which will be described further below, and the annular groove 65 also concentric with the axis 45 follow each other in this order, from the left to the right if one refers to FIGS. 2, 4, 6, and 8; these ducts or duct ends are in the form of enlargements, transverse of the axis 45, of the bore 44 which is circularly cylindrical about the axis 45 with a constant diameter D, for defining narrowings on both sides of the opening of each duct or duct end, with which narrowings a slide 67, slidingly mounted to follow the axis 45 in the bore 44, permits establishment of fluid-tight connections.

The slide 67 traverses the body 25 from one side to the other following the axis 45, via the bore 44, and has respectively on opposite sides of the body 25 an end 68 pivoted on the control lever 11 about an axis 71 perpendicular to the axis 45 and parallel to a pivot axis 72 of the lever 11 on the body 25, and an end 69 functionally connected to a return spring 70.

In the illustrated embodiment, where the end 68 pivoting on the lever 11 as well as the latter is situated at the right of the body 25 whilst the end 69 is situated at the left of it, the spring 70 is interposed between the extreme left face 73 of the body 25 and a recessed washer 74 positioned to the left of this face 73 and abutted, towards the left, against a head 75 which the slide 67 has at its end 69; thus, if, going from the initial state illustrated in FIG. 2, the lever 11 is tilted towards the left, sliding the slide 67 towards the right inside the bore 44, with respect to the body 25, the spring 70 is compressed, and tightens to return the control lever 11 and the slide 67 to the initial state when the action on the control lever 11 ceases; in the initial state illustrated in FIG. 2, in addition, the recessed washer 74 is abutted, towards the left, against a casing 76 carried in a fixed manner on the face 73 of the body 25; a movement of the slide 67 towards the left with respect to the initial state, corresponding to a tilting of the lever 11 towards the right with respect to this state, is nevertheless possible because the recessed washer 74 is slidingly mounted on the slide 67 between the head 75 of it, which constitutes an abutment for the recessed washer 74 towards the left with respect to the slide 67, and a shoulder 77 of the slide 67, which shoulder 77 constitutes an abutment on sliding to the right of the recessed washer 74 on the slide 67; however, in the case of such a movement of the slide 67 towards the left, the spring 70 applies no return effect towards the initial state; the full stroke position of the control lever 11 and of the slide 67 corresponding to a displacement of the latter towards the right is illustrated in FIG. 8, whilst the full stroke position of sliding of the slide 67 towards the left is illustrated in FIGS. 4 and 6.

Between its two ends 68 and 69, the slide 67 has the form of a circular cylindrical rod about the axis 45 and in which annular grooves concentric with this axis have been cut, respectively 78,79,80 and 81, in this succeeding order along the length of the axis 45, from left to right.

If one refers to the initial state illustrated in FIG. 2, the slide 67 has from left to right, from the shoulder 77 at its end 69 to its end 68:

a circular cylindrical zone 82 concentric with the axis 45 with a diameter D corresponding to that of the bore 44 outside the mouth, within which bore, the ducts or duct ends 34,63,46,43,66, and 65 open, this zone 82 being in peripheral fluid-tight contact with the bore 44 between the duct 34 and the face 73 whether the slide 67 occupies the initial position illustrated in FIG. 2 or the end of stroke positions illustrated in FIGS. 4, 6 and 8 or any intermediary position, the groove 78, permanently positioned in the duct 34 whatever the position of the slide 67, the groove 78 having an isosceles trapezium shape when viewed in a cross-section including the axis 45, a part 83 having the diameter D and being in peripheral fluid-tight contact with the bore 44 between the duct 34 and the groove 63 whatever the position of the slide 67, this zone 83 being also in fluid-tight contact with the bore 44 between the grooves 63 and 46 overlapping the groove 63 when the slide 67 is in its extreme rightwards position with respect to the body 25, illustrated in FIG. 8, as well as in the intermediary positions between the initial state and this full stroke state;

the groove 79, bridging the grooves 63 and 46 in the initial state illustrated in FIG. 2, as well as when the slide 67 occupies its extreme leftwards position illustrated in FIGS. 4 and 6 and in the intermediary positions between these two positions when it overlaps the groove 46 and the end 43 of the duct 42 in the extreme rightwards position of the slide 67 illustrated in FIG. 8, this groove 79 having when it is viewed in cross-section including the axis 45 the shape of a rectangular trapezium of which the right angle is defined by the connection with the zone 83;

a circular cylindrical zone 84 concentric with the axis 45 with a diameter D, in fluid-tight contact with the bore 44 between the groove 46 and the end 43 of the duct 42 in the initial state illustrated in FIG. 2 whilst it is positioned in the groove 46 in the extreme leftward position of the slide 67 illustrated in FIGS. 4 and 6 and the end 43 of the duct 42 in the extreme rightwards position of the slide 67 illustrated in FIG. 8;

the groove 80, positioned in the end 43 of the duct 42 in the initial state illustrated in FIG. 2, overlapping the groove 46 and this end 43 in the extreme leftwards position of the slide 67 illustrated in FIGS. 4 and 5, and overlapping this end zone 43 and the groove 66 in the extreme rightwards position of the slide 67 illustrated in FIG. 8, this groove 80 having when it is viewed in cross-section including the axis 45 the shape of a rectangular trapezium of which the right angle is defined by the connection with the following zone;

a circular cylindrical zone 85 concentric with the axis 45 with the diameter D, this zone 85 being in fluid-tight contact with the bore 44 between the end 43 of the duct 42 and the groove 66 in the initial state illustrated in FIG. 2 as well as in the extreme leftwards position of the slide 67 illustrated in FIGS. 4 and 6, in which it is in addition in fluid-tight contact with the bore 44 between the end 43 of the duct 42 and the groove 46 when it is in fluid-tight contact with the bore 44 between the groove 66 and 65 in the extreme rightwards position of the slide 67 illustrated in FIG. 8;

the groove 81, bridging the grooves 66 and 65 in the initial position illustrated in FIG. 2 when it coincides with the groove 66 in the extreme leftwards position of the slide 67 illustrated in FIGS. 4 and 6 and with the groove 65 in the extreme rightwards position of the slide 67 illustrated in FIG. 8, this groove 81 having the shape of an isosceles trapezium when it is viewed in cross-section including the axis 45;

a circular cylindrical zone 86 concentric with the axis 45 with the diameter D, this zone 86 being in fluid-tight contact with the bore 44 whatever the position mentioned above of the slide 67 with respect to the body 25, as well as with the bore 44 between the groove 65 and 66 in the extreme leftwards position of the slide 67 illustrated in FIGS. 4 and 6.

The different zones of the slide 67 which are described are also shown schematically in FIGS. 3, 5, 7 and 9.

In addition to the ducts 24,29,34,42,62, and 64 already described, the body 25 internally defines two other ducts 84,87 of which the first opens to the outside of the body 25 by an end 89 provided with connection means 90 to the duct 14 connecting with the jack 10, and of which the second opens to the outside of the body 25 by an end 91 provided with means 92 for connection to the return duct 15 towards the reservoir 5; the connection means 90 and 92 are for example constituted by threading internally the ducts 87 and 88.

The two ducts 87 and 88 are rectilinear, with respective axes 93,94 parallel between themselves and perpendicular on the one hand to the axis 45 and on the other hand to the common direction of the ducts 29 and 34 such that their ends 89 and 91 are accessible in spite of the juxtaposition of the different blocks and distribution sections 17,12,18, and 19 in the bank 16.

Each of these ducts 87 and 88 has in addition a second end, respectively 95 and 96; the duct 87 opens by its end 95 into the groove 66 of the body 25, whilst the duct 88 opens by its end 96 into the duct 34, of which it will be noted that by its mode of connection to its ends 33 and 47 with the ducts 30,49,52 and 64 it constitutes for the assembly of the distribution bank 16 a return collector towards the reservoir 5 via the duct 88.

Between their two ends, the ducts 87 and 88 are connected by a duct 97, having an axis 98 perpendicular to the axes 93 and 94 and parallel to the axis 45, in a position symmetric with that of the latter with respect to the pivot axis 72 of the lever 11 on the body 25, this duct 97 opening at one end 99 into the duct 88, between the two ends 91 and 96 of it, and meeting the duct 87 in an intersection zone 190 situated between the ends 89 and 95 of it, for presenting a second end 100 closed by a flat face 101, perpendicular to the axis 98, opposite its end 99 with respect to the intersection zone 190; it should be noted that, as a result of the respective positions of the duct 34 and the groove 66 by which the duct 88 and the duct 87 respectively open into the bore 44, the duct 87 is situated between the duct 88, placed to the left in FIGS. 2, 4, 6, 8 and the control lever 11, placed to the right in these Figures, and that the closed end 100 of the duct 97 constitutes the end of it closest to the lever 11.

The duct 97 has a generally circularly peripheral form about the axis 98, and is comprised of three sections limited by circular cylindrical surfaces about the axis 98, respectively 102,103 and 104 succeeding each other in this order from the end 99 to the end 100, that is to say from left to right with respect to FIGS. 2, 4, 6 and 8.

The surface 102, of diameter A itself communicating with a lower section to that of duct 88 and to that of duct 87, between the intersection zone 190 and the end 89 of this duct 87, extends to the end 99 of the duct 97 at an intermediate zone between the ducts 88 and 87, where it is connected by a truncoconical surface 105 about the axis 98 tapering in the direction of extension with respect to the end 99, to the surface 103 of which the diameter B is greater than A; this surface 103 extends, in the direction of extension with respect to the end 99 of the duct 97, across the zone of intersection 109 as far as a flat annular face 106, perpendicular to the axis 98, by which this surface 103 is connected to the surface 104 of diameter C intermediate between A and B; in the direction of extension with respect to the end 99 of the duct 97, this surface 104 is connected to the surface 101 defining the end 100 of the duct 97.

Inside the duct 97 is slidingly mounted, on the axis 98, between abutments defined by the surface 105 and the surface 101, a hollow piston 107 having a circular form with respect to the axis 98.

Transversely with respect to this axis 98, the piston 107 is limited at one end towards the end 99 of the duct 87, at the inside of the section of which is defined by its surface 102, by a flat annular face 108 perpendicular to the axis 98 and at the other end, towards the end 100 of the duct 97, at the interior of the section of which is defined by its surface 104, by a flat annular face 109 also perpendicular to the axis 98.

In the direction of radial extension with respect to the axis 98, the piston 107 is essentially limited by three surfaces 110,111,112 succeeding each other in this order from the face 108 to the face 109; these surfaces 110,111,112 are circularly cylindrical about the axis 98; the first 110 joins, with a diameter substantially corresponding to the diameter A, the end face 108 to a truncoconical surface 113 about the axis 98 tapering in the direction from the face 108 to the face 109 complementarily to the surface 105 of the duct 97, which surface 113 ensures the transition between the surface 110 and the surface 111 which have a diameter E intermediate between A and C, that is particularly to say less than B; the surface 111 has following the axis 98 a dimension approximately identical to that of the surface 103 of the duct 97 and joins also, in a direction going from the face 108 to the face 109, the transition surface 113 to a toric surface 114 about the axis 98, which surface 114 ensures the transition with the surface 112 which has a diameter substantially equal to C, for establishing a sliding fluid-tight contact between the surfaces 112 and 104, and joins this transition surface 114 to the end face 109 of the piston 107; it should be noted, following the axis 98, the surface 110 of the piston 107 has a length less than that of the surface 102 of the duct 97, and that between the connection of the surfaces 110 and 113 and the face 109, the piston 107 has a length less than that which separates the connection between the surfaces 102 and 105 and the face 101 of the duct 97.

Also, the piston 107 particularly can occupy the position illustrated in FIG. 2 in which it is in abutment, with fluid tightness, with the surface 113 against the surface 105 of the duct 97, in a direction going from the end 100 of the latter to its end 99, that is to say from right to left; in this position, the surface 110 is engaged in the surface 102, its face 108 resting nevertheless with respect to the end 99 of the duct 97 at the inside of the latter, and the surface 114 is connected to the surface 106 in a manner to limit, with the surface 111 of the piston 107 and the surfaces 103 and 105 of the duct 97, a passage 115 ensuring continuity of the duct 87 about the piston 107, in the transition zone 190, between the ends 89 and 95 of this duct 87; between the intersection zone 190 and the end 95 of connection of the duct 87 to the groove 66 of the bore 44, this continuity is ensured by the intermediary of a non-return valve constituted by a ball 116 which a spring 117 resiliently urges in a direction going from the end 89 towards the end 95, against a seat 118, circularly truncoconical about the axis 93 and converging from the end 89 towards the end 95, which the duct 87 has internally between the intersection zone 190 and this end; in this position, there is between the face 109 of the piston 107 and the face 101 of the duct 97 a distance which, measured in the direction of the axis 98, is less than the corresponding dimension of the surface 110 of the piston 107, so that this latter can also take up, by sliding inside the duct 97 towards the end 100 in the direction of the axis 98, an end of stroke position shown in FIG. 6, in which the face 109 is in contact with the face 101, the transition surfaces 113 and 105 being separated but the surface 110 resting partially engaged against the surface 102; in this position, the continuity of the duct 87 in the transition zone 190 remains ensured by the passage 115 when increased by the fact of the separation of the surfaces 105 and 113 on the one hand, and 114 and 106 on the other hand; in addition, in this position, communication is established between the passage 103, that is to say the duct 87, and the duct 88 by the bleed grooves 200 cut in the surface 110 of the piston 107 and extending in it, progressively tapering, from the transition surface 105 to the end face 108.

Internally, towards the axis 98, the piston 107 is limited by two surfaces 119 and 120 circularly cylindrical about the axis 98, connected between them by a surface 121 which is circularly truncoconical about this axis; the surface 119 has a diameter approximately equal to A and joins the face 109 to the surface 121, which converges from the face 109 towards the face 108 and ensures a transition between the surface 119 and the surface 120 which connects this surface 121 to the face 108 with a diameter F less than A.

The piston 107 and the duct 97 limit also, by the surfaces 121,119,109 of the piston, by the surface 101 of the duct 97 and by the part of the surface 104 of the latter possibly disengaged between the face 109 of the piston 107 and the face 108 of the duct 97, a chamber 122 communicating on the one hand, by the part of the duct 97 situated between the face 108 of the piston 107 and the end 99 of this duct 97, with the duct 88 via a calibrated passage 123 defined by the surface 120 of the piston 107 between the surfaces 121 and 108, and on the other hand with the duct 87, between the end 89 of it and the intersection zone 190, by a calibrated passage 124 having a circular section of diameter G less than F, in a manner to present a cross-section less than that of the passage 123; the passage 124, which is arranged in the body 25 in the non-limitative embodiment shown, opens into the chamber 122 by a zone of the surface 104 of the duct 97 placed in the immediate proximity of the end face 101 of this duct, this passage 124 being equally able to be arranged in the piston 107.

The junction between the surfaces 120 and 121 of the piston 107 defining as well a fluid-tight seat and an abutment, in the direction going from the face 109 of the piston 107 towards the face 108 of it, in the direction of the axis 98, for a needle 125 positioned internally of the chamber 122 and which has fixed to it a rectilinear shaft 126, on the axis 98, extending from this needle opposite from the passage 123, that is to say in a sense going from left to right in FIGS. 2, 4, 6 and 8, for presenting at the exterior of the body 25, opposite from the needle 125, an end 127 adapted to cooperate with the lever 11 in a manner which will be described below.

To this end, a wall of the body 25 defining the end face 101 of the duct 97 is pierced from side to side, on the axis 98, by a passage 128 adapted to provide, by contact with the shaft 126, a sliding guide for it with respect to the body 25 on the axis 98 as well as a fluid-tightness with respect to this shaft; it should be noted that the shaft 126 is sub-divided, in the direction of the axis 98, into two sections 129 and 130 of which the first, defining the end 127 and traversing the passage 128, has an external circular cylindrical surface about the axis 98 with a diameter H greater than the diameter F of the calibrated passage 123, the passage 128 having itself an internal peripheral surface also circularly cylindrical about the axis 98 with a diameter approximately equal to H, and of which the second, joining the first to the needle 125, has an external circularly cylindrical surface about the axis 98 with a diameter less than H and for example in the region of A.

A coil spring 131, arranged internally of the chamber 122 about the shaft 126 of the needle and compressed between the face 101 of the end of the duct 97 and a collar of the needle 125 elastically urges it against the support of its fluid-tight seat defined by the junction between the surfaces 120 and 121 of the piston 107, and in consequence also urges the latter into support by its surface 113 against the surface 105 of the duct 97, this corresponding to the position illustrated in FIG. 2.

At the exterior of the body 25, the end 127 of the shaft 126 is connected to the control lever 11 by means 132, arranged in a position diametrically opposed to that of the axis 71 with respect to the axis 72, and which ensure a connection in a simple manner translating a tilting of the control lever 11 towards the right, with sliding of the slide 67 towards the left with reference to the drawings, by a withdrawal of the needle 125 with respect to its fluid-tight seat whilst a movement of the control lever 11 and of the slide 67 in the reverse direction, and the maintaining of the lever 11 and slide 67 in the initial state illustrated in FIG. 2, is translated by a free application of the needle 125 against its fluid-tight seat, as well as a free mutual application of the surfaces 105 and 113.

To this end, the means 132 are constituted, in the illustrated embodiment, by a block 133 pivotally mounted on the lever 11 about an axis 134 parallel to the axes 72 and 71 and symmetric with respect to the latter about the axis 72, this block being in addition slidingly mounted, following the axis 98, on the section 129 of the shaft 126; it should be noted that the axis 134 and the axis 71 are defined, with respect to the control lever 11, by means known in themselves permitting their displacement with respect to this lever in the direction 135 connected to the latter perpendicular to the axis 72, itself fixed with respect to the lever 11 as well as with respect to the body 25, for permitting variations of the distance of these axes 134 and 71 with respect to the axis 72 on inclination of the lever 11.

Opposite the block 133 with respect to the needle 125, the shaft 126 itself carries in a fixed manner, at its end 127, an enlarged head 136 of which its spacing, in the direction of the axis 98, with respect to the needle 125 is such that, in the initial state illustrated in FIG. 2, it is in contact with the block 133 whilst the needle 125 is in fluid-tight contact with its seat on the piston 107 itself in fluid-tight contact by its surface 113 with the surface 105 of the duct 97.

The operation of the distributor 12 which has been described is as follows.

In the initial state, illustrated in FIGS. 2 and 3, the lever 11 is presumed to be vertical, the slide 67 occupies a middle position in the bore 44, with reference to the axis 45, and the needle 125 is applied in a fluid-tight manner against its seat in the piston 107 itself applied in a fluid-tight manner by its surface 113 against the surface 105 of the duct 97.

Then the groove 79 of the slide 67 ensures communication between the respective ends 46 and 63 of the ducts 24 and 62, which permit, across the distribution section constituted by the distributor 12, feeding of the following distribution section 18 on the one hand via the ducts 24 and 62 and on the other hand via the duct 29; the groove 81 also puts into communication the end 95 of the duct 87, that is to say the groove 66, with the groove 65 defining the end of the duct 64 but any possible return of the hydraulic fluid via duct 87, that is to say from the jack 10, towards the duct 15 and the reservoir 5 is prevented by the non-return valve which the ball 116 constitutes; such a return by the duct 88 is also prevented, a passage of the duct 87 to the duct 88 by the duct 97 being prevented by the cooperation of the needle 125 with its fluid-tight seat in the piston 107 and by the cooperation of the surface 113 of the latter with the surface 105 of the duct 97, under the action of the spring 131 and the pressure present in the chamber 122.

If, then, the jack 10 is deployed, the fork 8 being lifted, all return flow towards the reservoir 5 is thus avoided, and the fork 8 remains quite safely in its position.

When the control lever 11 is moved towards the right, as illustrated in FIGS. 4 to 7, the slide 67 is displaced towards the left, maintaining connection between the grooves 46 and 63 via the groove 79 but closing the end 43 of the duct 29 via the zone 85, the groove 65 at the end of the duct 64 by the part 86, and the groove 66 respectively on the one side and the other by their parts 85 and 86; in particular all connection between the duct 87 and the duct 13 connecting with the pump 4 is interrupted.

Simultaneously, the shaft 126 is drawn, via action of the block 133 on the head 136, in the direction of separation of the needle 125 from its fluid-tight seat in the piston 107, which brings about displacement of this needle, in the direction of the axis 98, to an extent corresponding to the inclination given to the lever 11 with respect to its initial position illustrated in FIG. 2, with compression of the spring 131; the needle 125 then separates from the principal piston 107, (see FIGS. 4 and 5), permitting escape towards the duct 98, via the calibrated passage 123, of fluid introduced into the chamber 122 via the passage 124, coming from the jack 10; there results an abrupt drop in pressure inside the chamber 122, as a result of the fact that the calibrated passage 123 has a greater cross-section than that of the passage 124, whilst the pressure in the chamber 103 remains constant; as a result of this fact, the force which, resulting from the pressure in the chamber 122, acts to hold the piston 107 in fluid-tight abutment via its surface 113 against the surface 105 of the duct 97 decreases to a lower value and becomes a force in the reverse direction developed by the pressure in the chamber 103; the piston 107 moves as a result in the direction of a separation of the surface 113 from the surface 105, to a position of equilibrium determined by the needle 125, permitting a controlled flow from the duct 87 to the duct 88, via the progressivity bleed grooves 200 of the surface 110 of the piston 107, proportional to displacement of the shaft 126 and the needle 125, that is to say to the inclination given to the lever 11 in comparison with its initial position (see FIGS. 5 and 6); this results in descent of the fork 8 at a controlled speed by choice of a greater or less inclination of the lever 11 with respect to its initial position.

When the fork 8 reaches a desired height along the length of the mast 7, the lever 11 is returned to its initial position, which also returns the slide 67 to its initial position and returns the needle 125 into fluid-tight contact with its seat in the piston 107 which, under the joint action of the spring 131 acting via the needle 125 and the pressure re-established in the chamber 122 thus closed, applies again via its surface 113 against the surface 105 of the duct 97.

When, for lifting the fork 8, the lever 11 is tilted towards the left as shown in FIG. 8, the slide 67 is displaced towards the right compressing the return spring 70, which closes the end 63 of the duct 62 via the zone 83 and places the groove 46 of the end of the duct 23 as well as the end 43 of the duct 29 in communication with the groove 66, via the grooves 79 and 80 and the progressivity bleed grooves 191 arranged in the transition between the zone 85 and the groove 80 on the slide 67; in other words, fluid under pressure from the pump 4 is introduced to the end 95 of the duct 87, and lifts the non-return valve constituted by the ball 116 for exit from the duct 87 towards the jack 10 via the passage 103; the shaft 126 remains itself immobile, the block 133 sliding on it, which maintains the needle 125 in fluid-tight contact with its seat in the piston 107 itself in fluid-tight contact via the surface 113 with the surface 105 of the duct 97, under the joint action of the return spring 131 and the pressure present in the chamber 122 (see FIGS. 8 and 9).

Return of the lever 11 to its initial position returns the assembly of elements to this position.

FIGS. 3, 5, 7 and 9 illustrate schematically the connections made in the positions of the distributor corresponding respectively to FIGS. 4, 6 and 8.

If, with the device in the initial state illustrated in FIG. 2, the pressure at the end 89 of the duct 87 increases excessively, for example due to the application of an excessive downwards force on the fork 8 when in their upper position or in a position intermediate between their upper and their lower position, there will appear inside the chamber 122, on account of the section 129 of the shaft 126 offering transversely to the axis 98 a greater section than that of the passage 123 on account of the difference between the diameters H and F, a force acting on the shaft 126 and the needle 125 in the direction of a separation of the latter from its fluid-tight seat in the piston 107; when this force exceeds a pre-determined value with respect to the calibration of the spring 131, the needle 125 separates from its seat in the piston 107, permitting controlled flow via the calibrated passage 123; there then results inside the chamber 122 an abrupt fall in pressure, in comparison with the pressure continuing to be present in chamber 103, with the same effect of displacing the piston 107 in the direction of a separation of its surface 105 with respect to the surface 113 when the lever is inclined towards the right as is illustrated in FIGS. 4 and 6; there is produced from this the fact that a return of fluid towards the duct 88, that is to say towards the reservoir 5, via the bleed grooves 200 and the duct 97; the pressure applied at the end 89 of the duct 87 decreases in consequence, to that which results in application to the shaft 126 and the needle 125 of a force lower than the predetermined value mentioned above; then, the needle 125 is reapplied against its fluid-tight seat in the piston 107 which itself again comes into application via its surface 113 against the surface 105, which returns the assembly to the initial state illustrated in FIG. 2; in the course of this opperation, the shaft 126 of the needle 125 slides in the block 133 of the lever 11, which remains immobile in its position illustrated in FIG. 2.

Naturally, numerous variants may be made to the described distributor 12 without departing from the scope of the present invention; in particular the lever 11, constituting common manual control means of first distributor means, constituted in this embodiment by the slide 67, and second distributor means, constituted by the assembly of piston 107 and needle 125, by hydraulic, pneumatic, electric, mechanical or other control means, if necessary distinct and indicated by arrows 201 and 202 as concerns respectively the slide 67 and the shaft 126 of the needle 125, in FIG. 2; these means will preferably be single-acting as concerns the control of the second distributor means 107–105 for permitting displacement of the needle 125 in the direction of separation with respect to its seat in the piston 107 in case of excess pressure at the end 89 of the duct 87 when the device is in its initial state, as has been mentioned above.

Variants of the Embodiment

By way of non-limitative example, two variants of the arrangement of the control means of the first and second distributor means are illustrated respectively in FIGS. 10 and 11.

In these variants, the actual distributor means as to their mode of cooperation with the different ducts of the body of the distributor remain substantially identical to that which has been described with respect to the embodiment of FIGS. 2 to 9, and the description of these Figures should be referred to in this respect; particularly there will be found substantially identical in FIG. 10 under the references 225, 244, 245, 265, 267, 268, 271, 272, 286, 287, 290, 297, 298, 300, 303 to 305, 307 to 309, 312, 313, 316, 322 to 326, 328, 329, 331, 332, 334, 390 and in FIG. 11 respectively under the references 425, 444, 445, 465, 467, 468, 471, 472, 486, 487, 490, 497, 498, 500, 503 to 505, 507 to 509, 512, 513, 516, 522 to 526, 528, 529, 531, 532, 534, 590 the elements which have been described above under the respective references 25, 44, 45, 65, 67, 68, 71, 72, 86, 87, 90, 97, 98, 100, 103 to 105, 107 to 109, 112, 113, 116, 122 to 126, 128, 129, 131, 132, 134 and 190; it will simply be noted that the shaft respectively 326 or 526, of the needle, respectively 325 or 525, has not only in its section, respectively 329 or 529, across the body of the distributor 225 or 425, but also between this section and the needle a greater cross-section to that of the calibrated passage, respectively 323 or 523, to be opened or closed by the needle, which brings about the possibility of opening of this calibrated passage by the needle in the case of the appearance of an over-pressure inside the chamber, respectively 322 or 522, which the piston, respectively 307 or 507, defines internally with the return duct, respectively 297 or 497, as was described with reference to the embodiment of FIGS. 2 to 9.

Also will be found in FIGS. 10 and 11, respectively under the reference 211 and under the reference 411, the lever 11 described above, if it is not limited to a rocking lever provided with means for direct manual gripping, and its mode of connection with the shaft of the needle is different.

If FIG. 10 is first referred to, it will be seen that the lever or rocking lever 211 is pivoted, in a manner identical to that described with reference to the lever 11, on the one hand on the end 268 of the slide 267, about an axis 271 perpendicular to the axis 245, and on the other hand on the body 225, or more precisely on a piece 602 connected solidly on this body and as one with it, about an axis 272 parallel to the axis 271; as has been said in connection with the lever 11, means not shown but known to the man in the art permit displacement of the axis 271 with respect to the lever 211, in a plane connected to the latter and including the axis 272 itself fixed with respect to the lever 211, in a manner to permit variation of the spacing of the axis 271 with respect to the axis 272 as a function of the inclination of the lever 211 whilst connected in a manner unique to this inclination a position of the slide 267 in sliding along its axis 245 inside the bore 244.

On the same side of the axis 272 as the axis 271, and opposite the body 225 with respect to this axis 271, the lever 211 carries in a fixed manner a socket 603 which, on the one hand, itself carries in a fixed manner a lever 624 for manual activation of the lever 211 to pivot about the axis 272 with respect to the body 225 and, on the other hand, has a blind threaded aperture 604 with an axis 605 parallel to the axis 245 and positioned on the other side of it with respect to the axis 272, for receiving a non-shown connecting link with appropriate control means, hydraulic, pneumatic, electric, mechanical or other, and for example with the shaft of a double-acting jack 606 itself controlled by manual action on a conventional hydraulic distributor 607.

Opposite the axis 271 with respect to the axis 272, about the axis 334 arranged approximately in the same manner as the axis 134 with respect to the lever 11 described above, the lever 211 carries in a fixed manner a pivot pin 608 having a circularly cylindrical exterior periphery 609 about the axis 334.

This pivot pin 608 is engaged in an eye 610 of a piece 611 which the shaft of the needle 326 carries in a fixed manner, as one with it, outside the body 225; for receiving the pivot pin 608, the eye 610 has a circularly cylindrical internal periphery 612 about the axis 613 connected to the shaft 326 and perpendicular to the axis 298, with a diameter substantially greater than that of the external periphery 609 of the pivot pin 608, in a manner to leave in all directions play 614 between the internal periphery 612 of the eye 610 and the external periphery 609 of the pivot pin 608.

Thus particularly a clearance of the pivot pin 608 inside the eye 610 in the direction of the axis 298 is permitted, this clearance being limited:

in a direction of approach of the pin 608 towards the needle 325, by an abutment 601 defined by the zone of the peripheral interior 612 of the eye 610 nearest to the needle 325, in the direction of the axis 298, and advantageously equally by the shaft 326 itself, being flush in this zone with an end face transverse with respect to the axis 298, in the direction of separation with respect to the needle 325, by the head of an abutment 336 of which the position, in the direction of the axis 298, inside the eye 610 can advantageously be adjusted by means 600.

In the non-limitative embodiment illustrated in FIG. 10, these means 600 are constituted by a screw 615 which can be screwed to a greater or lesser extent into a complementary threaded bore 616 arranged in the piece 611, in the direction of the axis 298, in a position diametrically opposed to the abutment 601; this bore 616 opens on the one hand at the inside of the eye 610, in which the screw 615 has opposite the abutment 601 an end defining the abutment head 336, and on the other hand at its opposite end, outside the piece 611, where the screw 615 has a slot 617 for receiving the blade of a screwdriver, and is provided with a locking nut 618 against the piece 611.

The possibility of adjusting the position of the abutment head 336 in the direction of the axis 298 with respect to the needle 325 offers a possibility of adjusting, by the operator, the degree of inclination of the lever 211 at which the needle 325 begins to be withdrawn from its fluid-tight seat in the piston 312 when, by action on the lever 624 or on the distributor 607, when it is wished to open the duct 287 towards the equivalent (not shown in FIG. 10) of the duct 88 in the embodiment of FIGS. 2 to 9, for causing at will a descent of the load if it is supposed that the distributor illustrated in FIG. 10 is arranged in the same manner as the distributor 12 illustrated in FIGS. 2 to 9, on a forklift truck of the type illustrated in FIG. 1.

This possibility of adjusting the position of the abutment head 336 with respect to the needle 325 permits in addition an adjustment of the maximum flow possible in the return circuit, that is to say from the duct 287 towards the equivalent of duct 88 via duct 297, and with this maximum flow the maximum speed of descent of the fork for the determined maximum possible inclination of the lever 211 in the direction of opening of this return circuit; in effect, the higher is the value of the inclination of the lever 211 for initial spacing movement of the needle 325 with respect to its fluid-tight seat in the piston, the less is the possible stroke of the needle until the lever 211 has achieved the maximum value of this inclination.

A maximum value of penetration of the screw 615 to the interior of the eye 610, corresponding to a minimum difference of diameter between the internal periphery 612 of the eye 610 and the external periphery 609 of the pivot pin 608 are nevertheless fixed, in a manner easily determined by the man of the art, so that when the lever 624 and the jack 606 occupy a corresponding position, for the lever 211, at the position of closure of the feed circuit and of the return circuit which have been described, in connection with the lever 11, referring to FIGS. 2 and 3, there exists as shown in FIG. 10, between the external periphery 609 of the pivot pin 608 and the abutment 601, sufficient play 614 to permit a movement of the needle 325 and, at the same time, its shaft 326 and of the eye 610 with respect to the pivot pin 608, in the direction of withdrawal of the needle 325 with respect to its fluid-tight seat in the piston 312, and to establish a safety against over-pressures as has been described in connection with the embodiment of FIGS. 2 to 9, so that for permitting an inclination of the lever 211 in the direction of opening of the feed circuit via the slide 267 to a maximum value of inclination corresponding to the obtaining of a maximum desired flow in this circuit; this play is chosen to be sufficiently weak so that, in the case of accidental blockage of the needle 325 and/or of the piston 312 in a position putting the duct 287 in communication with the equivalent to duct 88, via the return duct 297, an operator can, in acting on the lever 624 or on the jack 606 so that the lever 211 places the slide 267 in a position to establish the feed circuit, apply the external periphery 609 of the pivot pin 608 against the abutment 601 and thus return in a positive manner the needle 325 and the piston 312 into position interrupting the connection between the duct 287 and the equivalent of duct 88 via the return duct 297.

It should be noted that, in the embodiment of FIGS. 2 to 9, such positive closing can be made by direct manual action by the user on the abutment head 136 of the shaft 126 of the needle 125.

Referring now to FIG. 11, where under the references 411, 536, 800 to 817, will be found the assembly of elements which have been described respectively under the references 211, 336, 600 to 617 with reference to FIG. 10, with this sole exception that instead of being fixed to the lever 411, corresponding to the lever 211 as is the socket 603, the socket 803 to which it corresponds in this embodiment is directly pivoted on the end 468 of the distributor slide 467, about the pivot axis 471 of this slide on the lever 411, and that the axis 805 of the threading 804 for connection for example with a hydraulic control jack 806 is itself perpendicular to the axis 471; this embodiment does not have an equivalent to the direct manual control lever 624 of the distributor; for the other elements appearing in FIG. 11, and their mutual cooperation, reference should be made to FIG. 10.

Advantageously, the lever 211 or 411 and the mounting piece 602 or 802 for this lever on the body of the distributor 225 or 425, is arranged so that they are interchangeable, for permitting the mounting of levers 211 or 411 having different lever arms between on the one hand their pivoting on the body, and on the other hand, respectively, their pivoting on the first distributor means 267 or 467 and their pivoting on the second distributor means 307 to 325 or 507 to 525.

We claim: :

1. In a hydraulic distributor of the type comprising:

a body comprising a first inlet duct having connection means to a source of hydraulic fluid under pressure, a first outlet duct having connection means to utilisation means of such fluid, means forming a second entry duct having connection means to the utilisation means, a second outlet duct having connection means to a fluid reservoir, first distributor means positioned between said first inlet duct and said first outlet duct inside said body for, at will, establishing a fluid feed circuit from said inlet duct to said first outlet duct or closing said circuit, second distributor means, positioned between said means forming said second inlet duct and said second outlet duct inside said body, for, at will, establishing a fluid return circuit from said means forming said second inlet duct towards said second outlet duct or closing said circuit, control meansuof said first and second distributor means for, at will, establishing one of said circuits whilst closing the other or closing said two circuits simultaneously, said second distributor means comprise:

a return duct arranged in said body in a predetermined direction, said return duct, on the one hand, opens into said second outlet duct, and, on the other hand, has a communication zone with said means forming said second entry duct and has a closed end opposite said second outlet duct with respect to said communication zone, a non-return valve positioned in said first outlet duct between said connection means to said utilisation means and said first distributor means, said valve being elastically urged to its closed position in a direction from said means connecting to said utilisation means towards said first distributor means, a piston slidingly mounted along said direction in said return duct, in said communication zone and on both sides of it, said piston having respective end zones between said zone and said second outlet duct and between this zone and said end of said return duct said end zone positioned between said communication zone and said second outlet duct having transversely to said direction a cross-section less than that of the said end zone positioned between said communication zone and said end of said return duct, abutment means arranged complementarily on said piston and in said return duct, between said communication zone and said second outlet duct, said piston having between said corresponding abutment means and said end positioned between said communication zone and said end of said return duct a length less than that which said return duct has between its said end and said corresponding abutment means, said abutment means defining jointly a fluid-tight abutment of said piston with respect to said return duct in a direction from said end of the latter towards the second outlet duct, fluid-tight sliding contact means between said piston and said return duct between said communication zone and said end of said return duct, a chamber limited jointly by said piston and said return duct, between said end of it and said fluid-tight sliding contact means, a first calibrated passage opening at one end into said means forming said second inlet duct, between said communication zone and said means connecting said means forming said second inlet duct to said utilisation means, and the other end into said chamber, a second calibrated passage, arranged in said piston in said direction and opening at one end into said chamber and at said other end into said end zone of said piston positioned between said communication zone and said second outlet duct, said second calibrated passage having a cross-section greater than that of said first calibrated passage, a needle arranged in said chamber opposite said second calibrated passage in said direction, a fluid-tight seat for said needle, arranged in said piston about said second calibrated passage and constituting an abutment for said needle, with respect to said piston, in a direction leading from said chamber towards said second outlet duct in said direction, resilient means urging said needle towards said fluid-tight seat, control means translating a control in the direction of establishing the return circuit by a movement of said needle in the direction of a separation with respect to said fluid-tight seat, and a command in the direction of closing said two circuits or in the direction of establishing said feed circuit by free application of said needle on to said fluid-tight seat under the action of said resilient means, the improvement comprising:

said means forming said second inlet duct being constituted by said first outlet duct, of which said connection means to said utilisation means constitute said connection means of said means forming second entry duct to said utilisation means;

said communication zone of the said return duct with said means forming said second inlet duct being constituted by an intersection zone of said return duct with said first outlet duct, situated between said connection means to said utilisation means and said non-return valve;

a passage forming an integral part of said first outlet duct being limited jointly by said piston and said return duct in said intersection zone, between said abutment means, situated between said intersection zone and said second outlet duct, and said fluid-tight sliding contact means, situated between said intersection zone and said closed end of said return duct.

2. A hydraulic distributor according to claim 1, wherein:

said needle carries in a fixed manner a shaft;

said body has in said direction a passage orifice for said shaft opening at one end to the outside of said body and at the other end into said chamber; and said control means cooperate with said shaft for causing said movement of said needle at the outside of said body.

3. A hydraulic distributor according to claim 2, comprising direct manual drive means of said shaft of said needle for positively causing application of said needle onto said fluid-tight seat.

4. A hydraulic distributor according to claim 2, wherein:

said passage orifice of said shaft of said needle opens into said chamber at said closed end of said return duct;

said shaft comprises, across this orifice, a section having transversely to said direction a cross-section greater than the cross-section of said second calibrated passage; and the cooperation of said control means with said shaft of said needle is single-acting, permitting said movement of said needle on a command in the direction of closing of said return circuit.

5. A hydraulic distributor according to claim 1, wherein:

said distributor means comprises a distributor slide slidingly mounted in the body parallel to said direction;

said control means comprise a lever pivoted on the one hand to said body about an axis fixed with respect to said lever and with respect to said body, and on the other hand to said slide and on said shaft of said needle via single-acting connection means, about respective axes parallel with each other and to the pivot axis of said lever on said body and respectively disposed on opposite sides of said axis.

6. A hydraulic distributor according to claim 5, wherein said single-acting connection means comprise a member fixed to said control lever at least against a relative translation in said direction and free to a translation in said direction with respect to said shaft of said needle, and an abutment head fixed to said shaft and limiting said translation of said member fixed to said control lever with respect to said shaft in the direction of a separation with respect to said needle.

7. A hydraulic distributor according to claim 6, comprising means for adjusting the position of said abutment head with respect to said shaft of said needle in said direction.

8. A hydraulic distributor according to claim 6, wherein said shaft has in addition, fixed to it, means limiting said translation of said member fixed to said control lever with respect to said shaft in the direction of approach with respect to said needle.

9. A hydraulic distributor according to claim 1, wherein said respective control means of said first and second distributor means are distinct.

10. A hydraulic distributor according to claim 9, characterised in that said control means are chosen amongst manual means, hydraulic means, pneumatic means, electrical means and mechanical means.

11. A hydraulic distributor comprising:

a body comprising a first inlet duct having connection means to a source of hydraulic fluid under pressure, a first outlet duct having connection means to utilisation means of such fluid, means forming a second entry duct having connection means to the utilisation means, a second outlet duct having connection means to a fluid reservoir;

first distributor means positioned between said first inlet duct and said first outlet duct inside said body for, at will, establishing a fluid feed circuit from said inlet duct to said first outlet duct or closing said circuit;

second distributor means, positioned between said means forming said second inlet duct and said second outlet duct inside said body, for, at will, establishing a fluid return circuit from said means forming said second inlet duct towards said second outlet duct or closing said circuit;

control means of said first and second distributor means for, at will, establishing one of said circuits whilst closing the other or closing said two circuits simultaneously;

said second distributor means comprise:

a return duct arranged in said body in a predetermined direction, said return duct, on the one hand, opens into said second outlet duct and, on the other hand, has a communication zone with said means forming said second inlet duct and has a closed end opposite said second outlet duct with respect to said communication zone;

a non-return valve positioned in said first outlet duct between said connection means to said utilisation means and said first distributor means, said valve being elastically urged to its closed position in a direction from said connecting means to said utilisation means towards said first distributor means;

a piston slidingly mounted along said direction in said return duct, in said communication zone and on both sides of it, said piston having respective end zones between said zone and said second outlet duct and between this zone and said end of said return duct, said end zone positioned between said communication zone and said second outlet duct having transversely to said direction a cross-section less than that of the said end zone positioned between said communication zone and said end of said return duct;

abutment means arranged complementarily on said piston and in said return duct, between said communication zone and said second outlet duct, said piston having between said corresponding abutment means and said end positioned between said communication zone and said end of said return duct a length less than that which said return duct has between its said end and said corresponding abutment means, said abutment means defining jointly a fluid-tight abutment of said piston with respect to said return duct in a direction from said end of the latter towards the second outlet duct;

fluid-tight sliding contact means between said piston and said return duct between said communication zone and said end of said return duct;

a chamber limited jointly by said piston and said return duct, between said end of it and said fluid-tight sliding contact means;

a first calibrated passage opening at one end into said means forming said second inlet duct, between said communication zone and said means connecting said means forming said second inlet duct to said utilisation means, and the other end into said chamber;

a second calibrated passage, arranged in said piston in said direction and opening at one end into said chamber and at said other end into said end zone of said piston positioned between said communication zone and said second outlet duct, said second calibrated passage having a cross-section greater than that of said first calibrated passage;

a needle arranged in said chamber opposite said second calibrated passage in said direction;

a fluid-tight seat for said needle, arranged in said piston about said second calibrated passage and constituting an abutment for said needle, with respect to said piston, in a direction leading from said chamber towards said second outlet duct in said direction;

resilient means urging said needle towards said fluid-tight seat;

control means translating a control in the direction of establishing the return circuit by a movement of said needle in the direction of a separation with respect to said fluid-tight seat, and a command in the direction of closing said two circuits or in the direction of establishing said feed circuit by free application of said needle on to said fluid-tight seat under the action of said resilient means;

said means forming said second inlet duct being constituted by said first outlet duct, of which said connection means to said utilisation means constitute said connection means of said means forming said second entry duct to said utilisation means;

said communication zone of the said return duct with said means forming said second inlet duct being constituted by an intersection zone of said return duct with said first outlet duct, situated between said connection means to said utilisation means and said non-return valve, a passage forming an integral part of said first outlet duct being limited jointly by said piston and said return duct in said intersection zone, between said abutment means, situated between said intersection zone and said second outlet duct, and said fluid-tight sliding contact means, situated between said intersection zone and said closed end of said return duct;

said needle carrying in a fixed manner a shaft;

said body having in said direction a passage orifice for said shaft opening at the one end to the outside of the body and at the other end into said chamber at said closed end of said return duct;

said shaft comprising, across this orifice, a section having transversely of said direction a cross-section greater than that of the cross-section of said second calibrated passage;

said control means cooperating with said shaft, for causing said movement of said needle, outside said body; and cooperation of said control means with said shaft of said needle is single-acting, permitting said movement of said needle on control in the direction of closing of said return circuit.

12. A hydraulic distributor according to claim 11, comprising direct manual drive means of said shaft of said needle for causing positively application of said needle onto said fluid-tight seat.

13. A hydraulic distributor according to claim 11, wherein:

said distributor means comprises a distributor slide slidingly mounted in said body parallel to said direction; and said control means comprises a lever pivoted on the one hand to said body about an axis fixed with respect to said lever and with respect to said body, and on the other hand on said slide and on said shaft of said needle via single-acting control means, about respective axes parallel to each other and to said pivot axis of said lever on said body and respectively disposed on opposite sides of said axis.

14. A hydraulic distributor according to claim 13, wherein said single-acting connection means comprise a member fixed to the control lever, at least against a relative translation in the said direction and free to follow the said direction with respect to said shaft of said needle and an abutment head fixed to said shaft and limiting said translation of said member fixed to said control lever with respect to said shaft in the direction of separation with respect to said needle.

15. A hydraulic distributor according to claim 14, comprising means for adjusting the position of said abutment head with respect to said shaft of said needle in said direction.

16. A hydraulic distributor according to claim 14, wherein:

said shaft has in addition, in a fixed manner, means limiting said translation of said member fixed with said control lever with respect to said shaft the direction of approach with respect to said needle.

17. A hydraulic distributor according to claim 11, wherein:

said respective control means of said first and second distributor means are distinct.

18. A hydraulic distributor according to claim 11, wherein:

said control means are chosen amongst manual means, hydraulic means, pneumatic means, electrical means and mechanical means.

* * * * *